US009490096B2

(12) United States Patent
Moody et al.

(10) Patent No.: US 9,490,096 B2
(45) Date of Patent: Nov. 8, 2016

(54) MEDIUM VOLTAGE CONTROLLABLE FUSE

(71) Applicant: Mersen USA Newburyport-MA, LLC, Newburyport, MA (US)

(72) Inventors: Sean Moody, Amesbury, MA (US); Craig McKenzie, Methuen, MA (US); Kevin M Horne, Gloucester, MA (US); Song Chen, Medford, MA (US)

(73) Assignee: MERSEN USA NEWBURYPORT-MA, LLC, Newburyport, MA (US)

( * ) Notice: Subject to any disclaimer, the term of this patent is extended or adjusted under 35 U.S.C. 154(b) by 578 days.

(21) Appl. No.: 13/803,203

(22) Filed: Mar. 14, 2013

(65) Prior Publication Data

US 2014/0266563 A1 Sep. 18, 2014

(51) Int. Cl.

| | |
|---|---|
| ***H01H 85/38*** | (2006.01) |
| ***H01H 85/06*** | (2006.01) |
| ***H01H 85/00*** | (2006.01) |
| ***H01H 85/042*** | (2006.01) |
| ***H01H 85/08*** | (2006.01) |
| ***H01H 85/12*** | (2006.01) |

(52) U.S. Cl.

CPC ..... *H01H 85/38* (2013.01); *H01H 85/0039* (2013.01); *H01H 85/042* (2013.01); *H01H 85/06* (2013.01); *H01H 85/08* (2013.01); *H01H 85/12* (2013.01); *H01H 2085/388* (2013.01)

(58) Field of Classification Search

CPC .... H01H 85/38; H01H 85/08; H01H 85/042; H01H 2085/388; H01H 85/12; H01H 85/0039; H01H 85/0047; H01H 85/0052; H01H 85/0056; H01H 85/06

USPC ..... 337/162, 229, 290, 292, 401, 416

See application file for complete search history.

(56) References Cited

U.S. PATENT DOCUMENTS

| | | | | |
|---|---|---|---|---|
| 2,911,504 A | | 11/1959 | Cohn et al. | 200/135 |
| 3,259,719 A | | 7/1966 | Innis et al. | 200/120 |
| 3,304,390 A | | 2/1967 | Lindell | 200/120 |
| 3,486,155 A | | 12/1969 | McCaughna et al. | 337/231 |
| 3,571,776 A | | 3/1971 | Kozacka et al. | 337/161 |
| 3,648,210 A | | 3/1972 | Kozacka | 337/161 |
| 3,671,909 A | | 6/1972 | Kozacka et al. | 337/160 |
| 3,705,373 A | * | 12/1972 | Cameron | H01H 85/055 337/160 |
| 3,958,206 A | | 5/1976 | Klint | 337/406 |

(Continued)

FOREIGN PATENT DOCUMENTS

| | | |
|---|---|---|
| FR | 2694986 A1 | 2/1994 |
| GB | 385478 A | 12/1932 |

(Continued)

OTHER PUBLICATIONS

International Search Report and Written Opinion received in related PCT Application No. PCT/US2014/015929 dated May 26, 2014.

*Primary Examiner* — Anatoly Vortman
*Assistant Examiner* — Jacob Crum
(74) *Attorney, Agent, or Firm* — Kusner & Jaffe

(57) ABSTRACT

A medium voltage controllable fuse that provides fast activation in response to both low current and high current faults, and at load currents in response to an external condition detected by an external sensing device. The controllable fuse includes a high-current fault interrupting section, a low-current fault interrupting section, and a trigger element responsive to a fuse controller.

20 Claims, 7 Drawing Sheets

(56) References Cited

U.S. PATENT DOCUMENTS

| | | | | | |
|---|---|---|---|---|---|
| 4,090,164 | A | | 5/1978 | Mikulecky | 337/159 |
| 4,123,738 | A | | 10/1978 | Huber | 337/159 |
| 4,198,615 | A | * | 4/1980 | Mahieu | 337/162 |
| 4,253,080 | A | | 2/1981 | Howard | 337/159 |
| 4,383,236 | A | | 5/1983 | Urani et al. | 337/142 |
| 4,486,734 | A | | 12/1984 | Leach | 337/162 |
| 4,593,262 | A | | 6/1986 | Krueger | 337/163 |
| 4,617,544 | A | | 10/1986 | Mooz et al. | 337/3 |
| 4,638,283 | A | * | 1/1987 | Frind | H01H 85/38 337/162 |
| 4,689,596 | A | | 8/1987 | Huber | 337/159 |
| 4,692,734 | A | * | 9/1987 | Swanson et al. | 337/162 |
| 4,920,446 | A | | 4/1990 | Pflanz | 361/93 |
| 4,952,900 | A | | 8/1990 | Cameron et al. | 337/217 |
| 5,036,769 | A | | 8/1991 | Schaff et al. | 102/221 |
| 5,084,691 | A | | 1/1992 | Lester et al. | 337/297 |
| 5,252,942 | A | | 10/1993 | Gurevich | 337/163 |
| 5,254,967 | A | | 10/1993 | Biasutti et al. | 337/165 |
| 5,406,438 | A | | 4/1995 | Ranjan et al. | 361/104 |
| 5,485,136 | A | | 1/1996 | Johnson et al. | 337/168 |
| 5,604,474 | A | | 2/1997 | Leach et al. | 337/158 |
| 5,714,923 | A | * | 2/1998 | Shea et al. | 337/159 |
| 5,805,046 | A | * | 9/1998 | Hassler et al. | 337/168 |
| 5,892,427 | A | | 4/1999 | Handcock | 337/160 |
| 6,141,202 | A | | 10/2000 | Maeckel et al. | 361/187 |
| 6,256,183 | B1 | | 7/2001 | Mosesian | 361/104 |
| 6,614,340 | B2 | | 9/2003 | Handcock et al. | 337/292 |
| 7,253,637 | B2 | | 8/2007 | Dvorak et al. | 324/536 |
| 7,965,477 | B1 | | 6/2011 | Morgan et al. | 361/42 |
| 7,969,275 | B2 | | 6/2011 | Hartzog | 337/292 |
| 8,279,573 | B2 | | 10/2012 | Wu et al. | 361/115 |
| 2002/0109574 | A1 | | 8/2002 | Handcock et al. | 337/292 |
| 2008/0117015 | A1 | | 5/2008 | Leach | 337/238 |
| 2012/0299692 | A1 | | 11/2012 | Whitney et al. | 337/297 |

FOREIGN PATENT DOCUMENTS

| | | | |
|---|---|---|---|
| JP | 2011-113907 | A | 6/2011 |
| KR | 10-2006-0053324 | A | 5/2006 |

* cited by examiner

MEDIUM VOLTAGE CONTROLLABLE FUSE

FIELD OF THE INVENTION

The present invention relates generally to the field of electrical protection devices, more particularly to an electric current interruption device, and even more particularly to a medium voltage current-limiting fuse.

BACKGROUND OF THE INVENTION

Medium voltage (MV) current-limiting fuses are widely used in the electrical utility and switchgear manufacturing industries for voltages typically in the range of 1 kV to 72.5 kV. The main function of such fuses is to protect electrical apparatus (e.g., distribution transformers, motors, and capacitor banks) against overcurrents.

Existing MV current-limiting fuses have been observed to be too slow to activate in certain situations. In this regard, there is a need in various applications for an MV current-limiting fuse that can more quickly activate at low current faults and can activate at load currents in response to an external condition at load currents.

The present invention provides a MV current-limiting controllable fuse that address these and other needs that are not met by prior art devices.

SUMMARY OF THE INVENTION

In accordance with the present invention, there is provided A medium voltage controllable fuse comprising: (a) a high-current fault interrupting section responsible for opening the fuse and extinguishing arcs in the event of a high current fault, said high current interrupting section including a fuse element comprised of a conducting member; (b) a low-current fault interrupting section responsible for opening the fuse and extinguishing arcs in the event of a low current fault, said low-current fault interrupting section including a fuse element comprised of a first conducting member and a second conducting member, wherein the low-current fault interrupting section is series-connected with the high-current fault interrupting section; (c) a trigger element comprised of at least one trigger wire including an exothermic reactive intermetallic material, wherein said trigger element responds to an external trigger signal by rapidly heating and initiating an exothermic reaction that destroys the trigger element, said trigger element located proximate to the second conducting member; and (d) a fuse body for housing said high-current fault interrupting section, low-current fault interrupting section and trigger element.

In accordance with another aspect of the present invention, there is provided a fuse system comprising: a medium voltage controllable fuse including: (a) a high-current fault interrupting section responsible for opening the fuse and extinguishing arcs in the event of a high current fault, said high current interrupting section including a fuse element comprised of a conducting member, (b) a low-current fault interrupting section responsible for opening the fuse and extinguishing arcs in the event of a low current fault, said low-current fault interrupting section including a fuse element comprised of a first conducting member and a second conducting member, wherein the low-current fault interrupting section is series-connected with the high-current fault interrupting section, (c) a trigger element comprised of at least one trigger wire including an exothermic reactive intermetallic material, wherein said trigger element responds to an external trigger signal by rapidly heating and initiating an exothermic reaction that destroys the trigger element, said trigger element located proximate to the second conducting member, and (d) a fuse body for housing said high-current fault interrupting section, low-current fault interrupting section and trigger element; a fuse controller electrically connected with said trigger element; and a sensing device for sensing an external condition.

An advantage of the present invention is the provision of a MV current-limiting controllable fuse that responds rapidly to interrupt the electrical current in the event of both low and high current fault conditions.

Still another advantage of the present invention is the provision of a MV current-limiting controllable fuse that is responsive to an external condition, such as an arc flash, an overvoltage condition, a temperature level, a pressure level, etc.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE INVENTION

Figure 1:
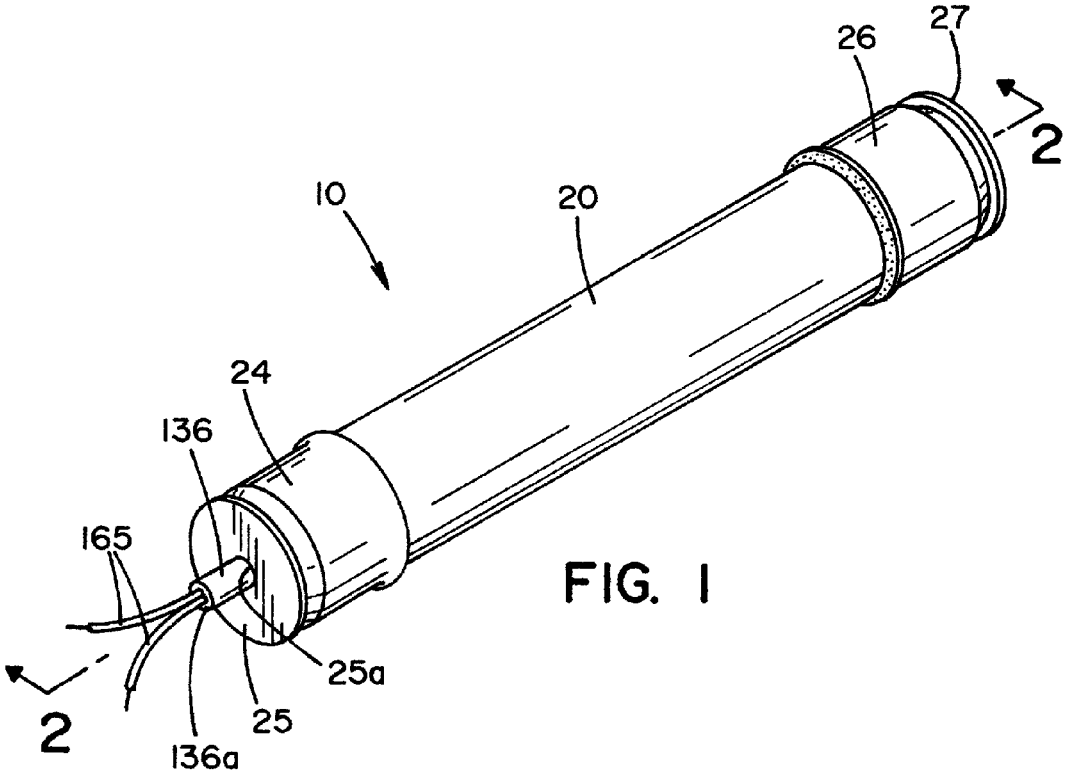
FIG. 1 is a perspective view of a MV current-limiting controllable fuse according to an embodiment of the present invention.

Referring now to the drawings wherein the showings are for the purposes of illustrating a preferred embodiment of the invention only and not for the purposes of limiting same, FIG. 1 shows a perspective view of a MV current-limiting controllable fuse 10 according to an embodiment of the present invention. Fuse 10 is generally comprised of a tubular fuse body 20 and a fuse link comprised of a high-current fault interrupting section 80 and a low-current fault interrupting section 100, electrically connected in series.

Figure 2:
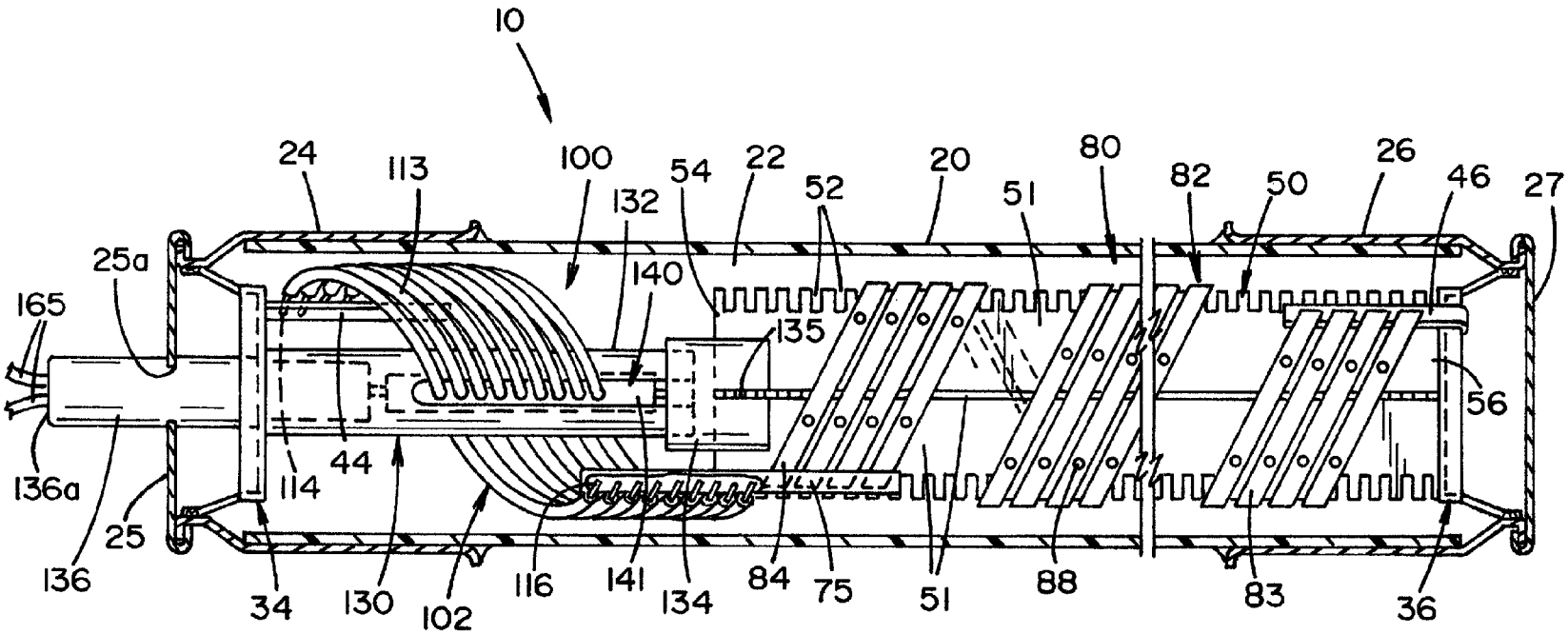
FIG. 2 is a cross-sectional view of the MV current-limiting controllable fuse taken along lines 2-2 of FIG. 1.

Referring now to FIGS. 1 and 2, fuse body 20 has an inner chamber 22 with first and second conductive end caps 24 and 26, respectively mounted at opposite ends of fuse body 20, that serve as fuse terminals. Inner chamber 22 houses high-current and low-current fault interrupting sections 80, 100. Open space of inner chamber 22 is filled with a conventional arc-quenching material (not shown), such as granular quartz, sand, silica, or other suitable materials well known in the art. First end cap 24 has a front face 25 and second end cap 26 has a front face 27. In the illustrated embodiment, front face 25 of first end cap 24 has an opening 25*a* formed therein. End caps 24, 26 may be secured to fuse body 20 using an adhesive, pins, or other mechanical fastening means. Fuse body 20 is made of a heat resistant insulating material (such as a ceramic or the like), while end caps 24 and 26 are made of a conductive material (such as brass, copper, copper alloys, or the like).

High-current fault interrupting section 80 is generally comprised of an internal holder or core 50 (also known as a "star-core" or "spider") and a fusible element 82 primarily responsible for high-current faults. Fusible element 82 controls the high-fault current interruption part of the time-current curve associated with fuse 10. A high-current fault refers to a fault current that is greater than approximately 15 times the rated current of fuse 10.

Figure 3:
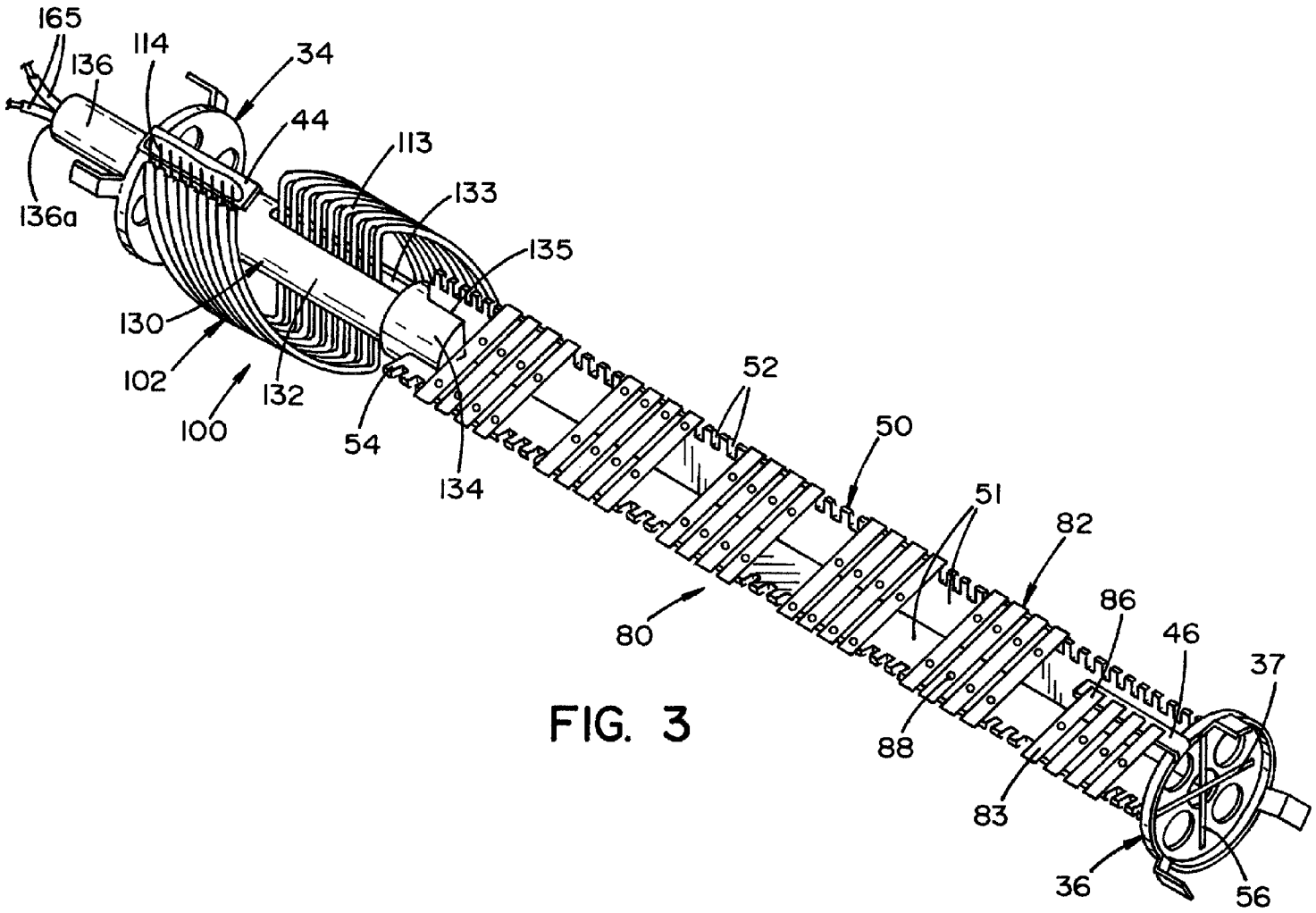
FIG. 3 is a perspective view of high-current and low-current fault interrupting sections of the MV current-limiting controllable fuse shown in FIG. 1.

Internal core 50 is comprised of intersecting fins or blades 51, as best seen in FIG. 3. Internal core 50 has a first end 54 and a second end 56, wherein second end 56 mechanically interfaces with a conductive contact member 36 that is electrically connected with second end cap 26 of fuse body 20. Conductive contact member 36 is welded, brazed, or otherwise conductively secured to end cap 26, and includes a conductive connecting plate 46. Slots 37 formed in conductive contact member 36 are dimensioned to receive blades 51 of internal core 50. A plurality of recesses or notches 52 formed along the length of blades 51 are dimensioned to receive fusible element 82 that is spirally wound around internal core 50. Internal core 50 is made of an insulating material, such as mica or a ceramic.

Fusible element 82 is comprised of one or more conducting members 83 arranged in parallel, wherein each conducting member 83 has a first end 84 and a second end 86. Second end 86 is electrically connected to conductive contact member 36 at conductive connecting plate 46. The surface area of fusible element 82 is preferably enlarged to increase contact with arc quenching material inside inner chamber 22. Accordingly, in the illustrated embodiment, each conducting member 83 takes the form of a flat ribbon to increase surface dimensions. Furthermore, each conducting member 83 is spirally wound around internal core 50 to increase the total length of conducting member 83. The ribbon of the illustrated embodiment has notches and/or perforations 88 formed therein. The notches and/or perforations 88 limit the peak arc voltage and make it possible to distribute the thermal duty of the arc-quenching material over a larger area. Fusible element 82 is made of a metal having good conductivity and a high melting point temperature (typically, 400° C.-1200° C.), such as silver, copper, copper alloy, aluminum, zinc, or the like.

Figure 4:
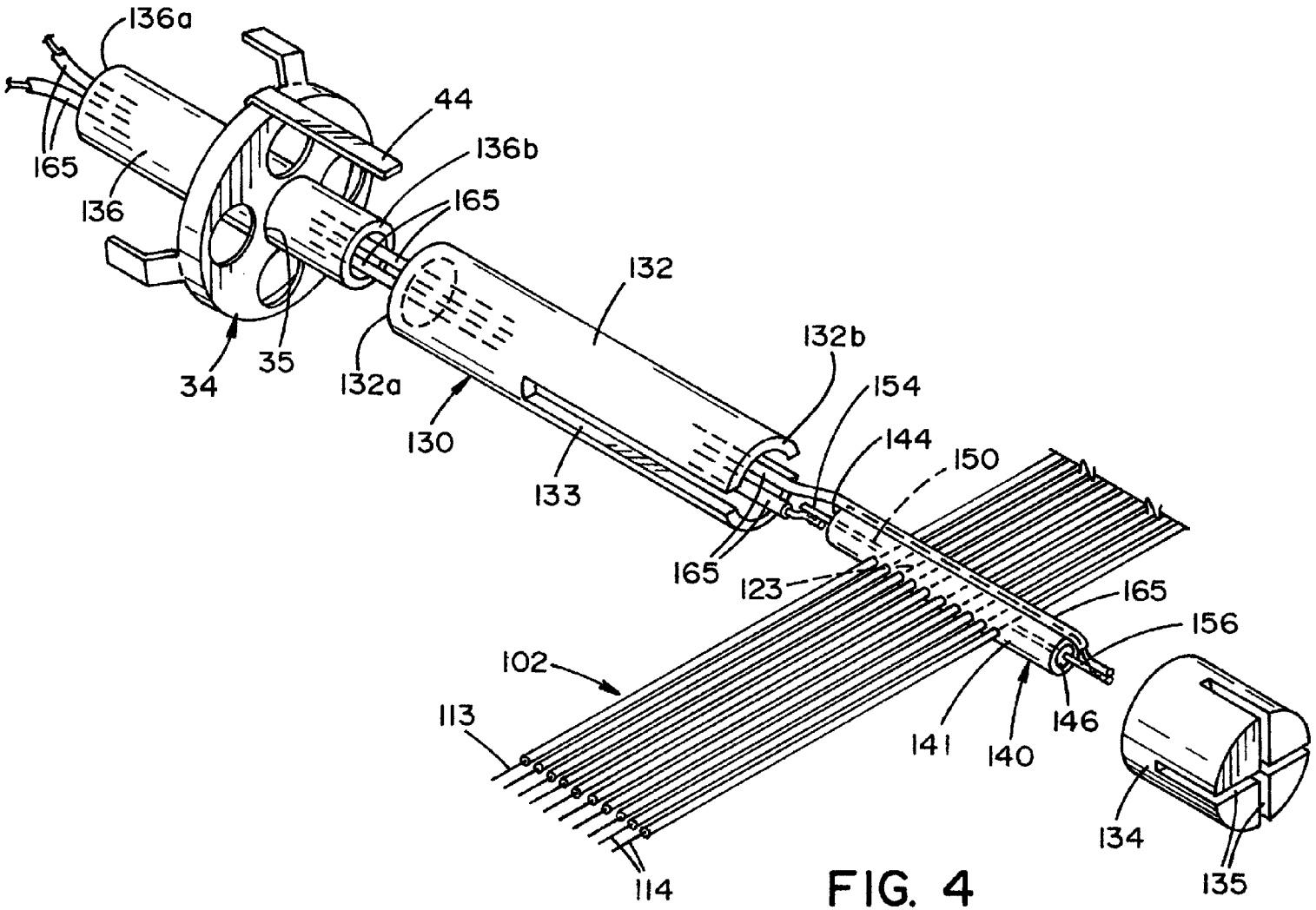
FIG. 4 is an exploded perspective view of the low-current fault interrupting section of the MV current-limiting controllable fuse shown in FIG. 1.

Referring now to FIGS. 2-4, low-current fault interrupting section 100 is generally comprised of a fusible element 102 primarily responsible for low-current faults, a housing 130, and an isolating member 140. Fusible element 102 controls the low-fault current interruption part of the time-current curve associated with fuse 10. A low-current fault refers to a fault current that is less than approximately 15 times the rated current of fuse 10. Fusible element 102 is preferably spirally wound within inner chamber 22 of fuse body 20, as seen FIGS. 2 and 3.

Figure 5:
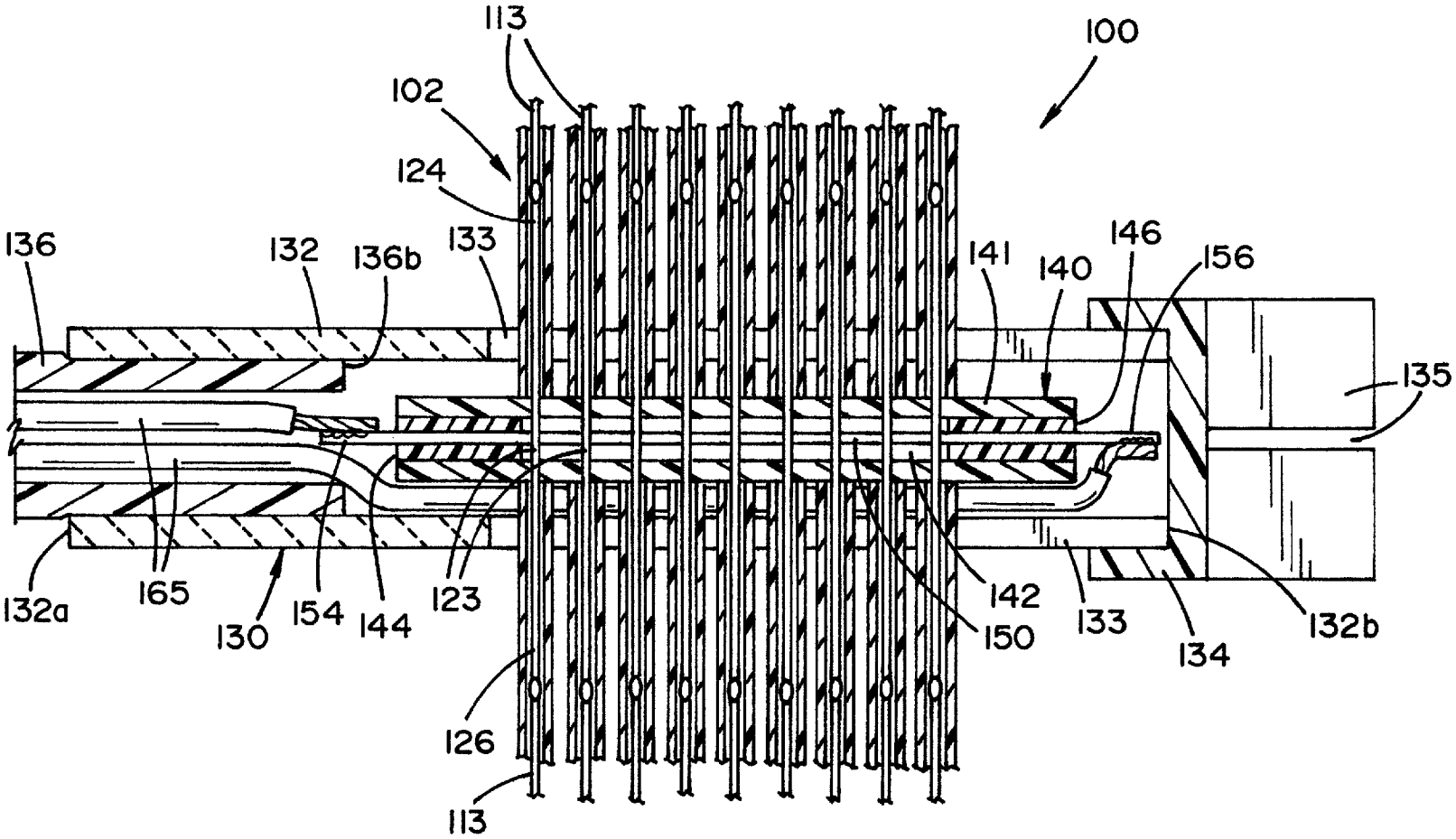
FIG. 5 is a cross-sectional view of a portion of the low-current fault interrupting section according to a first embodiment.

According to a first embodiment of the present invention, low-current fault interrupting section 100 has a two-part fusible element 102. In this regard, fusible element 102 includes one or more first conducting members 113 (arranged in parallel) and one or more second conducting members 123 (arranged in parallel), as best seen in FIG. 5.

First conducting member 113 is preferably a wire made of a metal having good conductivity and a high melting point temperature (typically, 600° C.-1200° C.), such as silver, copper, copper alloy, aluminum, or the like. In the illustrated embodiment, the wire is protected with an insulating sleeve.

Each first conducting member 113 has a first end 114 and a second end 116, as shown in FIGS. 2-4. First end 114 of first conducting member 113 is electrically connected to a conductive contact member 34 that is electrically connected with conductive first end cap 24 of fuse body 20. Conductive contact member 34 is welded, brazed, or otherwise conductively secured to end cap 24 of fuse body 20, and includes an opening 35 and a conductive connecting plate 44. In the illustrated embodiment, first end 114 of first conducting member 113 is electrically connected to conductive contact member 34 via conductive connecting plate 44.

Second end 116 of first conducting member 113 is series-connected to first end 84 of conducting member 83. In the illustrated embodiment, second end 116 of first conducting member 113 is electrically connected to conducting member 83 via a conductive interface plate 75, as shown in FIG. 2. Conductive interface plate 75 is preferably made of tinned copper. However, it is contemplated that second end 116 of first conducting member 113 may alternatively be directly electrically connected to conducting member 83 (e.g., via high-temperature solder).

As seen in FIG. 5, second conducting member 123 has a first end 124 and a second end 126. Second conducting member 123 is inserted within a segment of the first conducting member 113 and is series-connected with first conducting member 113. First and second ends 124, 126 of second conducting member 123 are soldered directly to first conducting member 113 using a high temperature solder. Alternatively, first and second ends 124, 126 of second conducting member 123 may be welded to first conducting member 113.

Second conducting member 123 is made of an exothermic reactive intermetallic material that can undergo a self-sustaining exothermic reaction. It should be appreciated that the exothermic reaction is not considered to be of an explosive or pyrotechnic nature, since the only energy released is thermal. In the illustrated embodiment, second conducting member 123 is made of a palladium-clad aluminum wire or ribbon ("Pd—Al wire"), also commonly referred to as Pyrofuze®, from Sigmund Cohn. Alternative exothermic reactive intermetallic materials include, but are not limited to, a nickel-clad aluminum wire or ribbon ("Ni—Al wire"), commonly known as NanoFoil®, from Indium Corporation.

Pyrofuze® is a clad wire or ribbon fuse member comprised of two metallic elements in intimate contact with each other, namely, (1) a solid inner core element, made of aluminum, and (2) a sheath or outer jacket that encircles the inner core element, made of 5% ruthenium and the balance palladium. When these two metallic elements are heated to an initiation temperature (e.g., by passing a current therethrough), they alloy rapidly resulting in instant deflagration without support of oxygen. The minimum initiation temperature is 650° C. and the minimum reaction temperature is 2800° C.

As best seen in FIGS. 2, 4 and 5, isolating member 140 isolates at least a section of second conducting member 123 from the arc-quenching material (not shown) and provides an air void ("void area") around at least a section of second conducting member 123. In the illustrated embodiment, isolating member 140 takes the form of a sleeve or tubular casing 141 that defines a cylindrical inner recess 142, and a pair of end walls 144, 146 that enclose cylindrical inner recess 142 (see FIG. 5). End walls 144 and 146 have respective openings formed therein. Isolating member 140 provides an air void around at least a section of second conducting member 123. In this regard, at least a section of second conducting member 123 is housed within inner recess 142 of isolating member 140. As shown in FIG. 5, second conducting member 123 extends through openings formed in tubular casing 141. In the illustrated embodiment, tubular casing 141 and end walls 144, 146 are made of silicone. Alternative materials for isolating member 140 include, but are not limited to a GMG (glass-malamine-glass) composition and plastic composition.

It should be understood that in accordance with a first embodiment of the present invention, Pd—Al wire is used for only a limited portion of fusible element 102 because it is more costly and has a higher resistivity than the metal wire comprising first conducting members 113. It is desirable to use highly conductive material for the conducting members of high-current and low-current fault interrupting sections 80, 100.

Fuse 10 also includes a trigger element comprised of one or more trigger wires 150 located inside inner recess 142 of isolating member 140 (see FIG. 5). In the illustrated embodiment, there is a single trigger wire 150 having a first end 154 and a second end 156, that is oriented generally transverse to second conducting member 123. Therefore, all of the second conducting members 123 are proximate to trigger wire 150 within inner recess 142. Trigger wire 150 is also made of an exothermic reactive intermetallic material. In the illustrated embodiment, the exothermic reactive intermetallic material is Pd—Al wire. Outside of isolating member 140, first and second ends 154, 156 of trigger wire 150 are series-connected with conventional copper connecting wires 165 as best seen in FIG. 4. Connecting wires 165 must be of sufficient cross-sectional area so as not to melt during the trigger signal (described below). For example, in one embodiment, connecting wires 165 are 18 AWG copper wire. Connecting wires 165 extend outside of fuse body 20 for connection to a fuse controller, as will be explained below.

With reference to FIGS. 2-5, housing 130 of low-current fault interrupting section 100 houses tubular casing 141, trigger wire 150, and at least a portion of connecting wires 165. In the illustrated embodiment, housing 130 is generally comprised of a cylindrical body 132, a cap 134 and a tube 136, as best seen in FIG. 4.

Cylindrical body 132 has first and second ends 132*a*, 132*b*. Cap 134 is press fit (or glued) over second end 132*b* to close second end 132*b* of cylindrical body 132. An outer face of cap 134 has slots 135 that are dimensioned to receive blades 51 of internal core 50, as best seen in FIG. 3. A second end 136*b* of tube 136 is press fit (or glued) into first end 132*a* of cylindrical body 132. A first end 136*a* of tube 136 extends through opening 35 of conductive contact member 34 and through opening 25*a* of first end cap 24. A pair of channels may be provided at first end 136*a* to guide connecting wires 165 through tube 136. As best seen in FIGS. 3 and 4, a recess 133 is formed in cylindrical body 132 that is dimensioned to allow first conducting member 113 to extend therethrough.

Cylindrical body 132 provides a reinforcing wall to protect fuse body 20 from damage during the high temperature exothermic reactions of trigger wire 150 and second conducting member 123. In the illustrated embodiment, cylindrical body 132 is made of a GMG composition, and cap 134 and tube 136 are made of an insulating material, such as a plastic, Teflon®, a phenolic compound, or the like.

Figure 7:
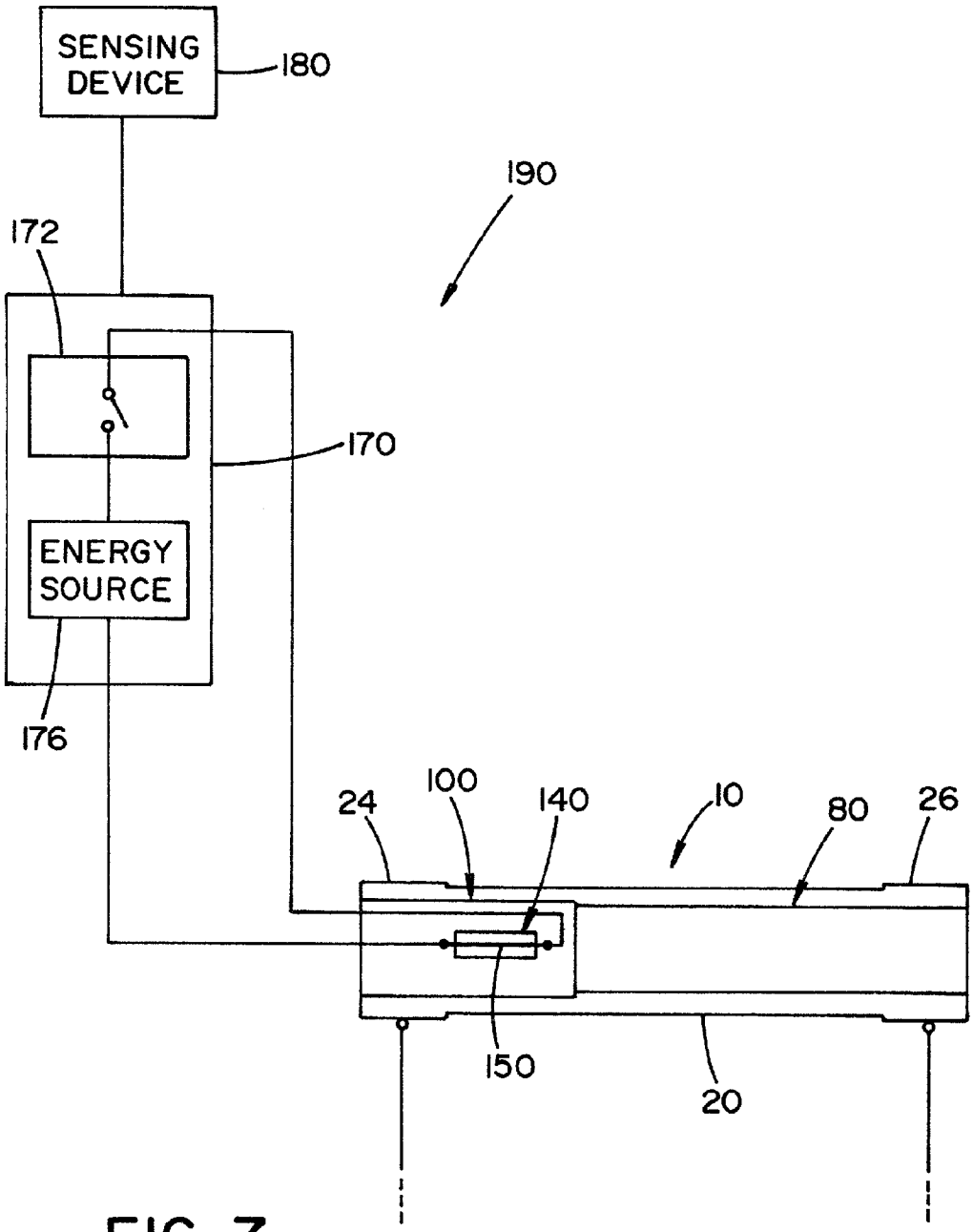
FIG. 7 is a schematic block diagram showing a fuse system that includes a fuse controller connected with the MV current-limiting controllable fuse.

It is contemplated that fuse 10 will be used in connection with a fuse controller 170 and a sensing device 180, as shown in FIG. 7. Fuse 10 in combination with fuse controller 170 and sensing device 180 form a fuse system 190. In the illustrated embodiment shown in FIG. 7, controller 170 includes a microprocessor or other control circuit (not shown), a switch 172, an energy source 176 that provides a pulse of energy (such as a charged capacitor or isolated power supply), and a power supply (not shown), such as a rechargeable battery.

Sensing device 180 detects an external condition or event, such as an arc flash, an overvoltage condition, a temperature level, a pressure level, etc. In response to detection of the external condition, controller 170 is programmed to command fuse 10 to open by supplying a "trigger signal" (i.e., a pulse of electrical energy) to trigger wire 150 via connecting wires 165. In this regard, controller 170 causes energy source 176 to apply sufficient electrical energy to trigger wire 150 to heat trigger wire 150 to a temperature at which an exothermic reaction is initiated and propagates through low current interrupting section 100. While fuse controller 170 in FIG. 7 has been shown connected to a single fuse 10, it is also contemplated that fuse controller 170 may also be connected to a plurality of fuses 10.

In the illustrated embodiment, controller 170 responds to sensing device 180 (e.g., a light sensor or dedicated arc flash detection equipment) detecting an external condition or event (e.g., an arc flash) by closing switch 172, and thereby applying a rapid pulse of electrical energy from energy source 176 (e.g., 1000 uF capacitor charged to 50V) to trigger wire 150.

For example, when a charged capacitor is discharged by fuse controller 170, a large surge of current flows through trigger wire 150 as a trigger pulse or signal, thereby causing rapid heating of trigger wire 150. As a result, trigger wire 150 quickly reaches the temperature at which the exothermic reaction is initiated, thereby destroying trigger wire 150. The exothermic reaction also propagates to the proximately located second conducting members 123 (also formed of Pd—Al wire) of low-current fault interrupting section 100 which causes destruction of second conducting member 123, thus "opening" fuse 10 and extinguishing arcing. The first conducting member 113 also contributes to extinguish arcing. Therefore, as a result of controller 170 operations and the fast reaction of the exothermic reactive intermetallic material, fuse 10 rapidly opens (e.g., under 1 second).

Fuse 10 can be operated in both (1) a control mode and (2) a normal operating mode. In the control mode, the fuse 10 is activated in response to the detection of a condition by sensing device 180, as described above. It should be appreciated that the external condition or event (an arc flash fault) may occur at a low overload current, or at a load current that is less than the rated current of fuse 10, and thus would not cause activation of fuse 10 in the normal operating mode discussed below.

In the normal operating mode (i.e., when no external condition or event is detected by sensing device 180), fuse 10 is not activated by controller 170 applying electrical energy to trigger wire 150. Instead, fuse 10 is activated in response to the presence of a low-current fault or high-current fault. These two operating modes are described in detail below.

Fuse 10 operates in the normal operating mode in the event of either a low current fault or a high current fault. As indicated above, fusible element 102 of low current fault interrupting section 100 controls the low fault current interruption part of the time-current curve associated with fuse 10. If a low current fault occurs, the Pd—Al wires of second conducting member 123 of low-current fault interrupting section 100 are rapidly heated to an initiating temperature, thereby resulting in the destruction of second conducting members 123. First conducting member 113 also responds to the low current fault subsequent to the heating of second conducting member 123 by melting to rapidly "open" fuse 10 and extinguish arcing.

As indicated above, fusible element 82 of high-current fault interrupting section 80 controls the high current fault interruption part of the time-current curve associated with fuse 10. If a high current fault occurs, conducting member 83 of high-current fault interrupting section 80 melts to rapidly "open" fuse 10 and extinguish arcing. First and second conducting members 113, 123 of low-current fault interrupting section 100 also melt in response to the high current fault.

For example, if fuse 10 is rated at $I_n$=100 A, then low-current interrupting section 100 is relied upon to respond to a current I greater than 100 A but less than 1500 A, while high-current interrupting section 80 is relied upon to respond to a current I greater than or equal to 1500 A. It should be appreciated that there are a range of currents around this level where both low-current fault interrupting section 100 and high-current fault interrupting section 80 will respond and aid each other in interruption.

It should be understood that while fuse controller 170 and sensing device 180 are illustrated as being external to fuse 10, it is contemplated that fuse controller 170, or fuse controller 170 and sensing device 180, may be configured to be located along with fuse 10 at a fuse holder.

Figure 6:
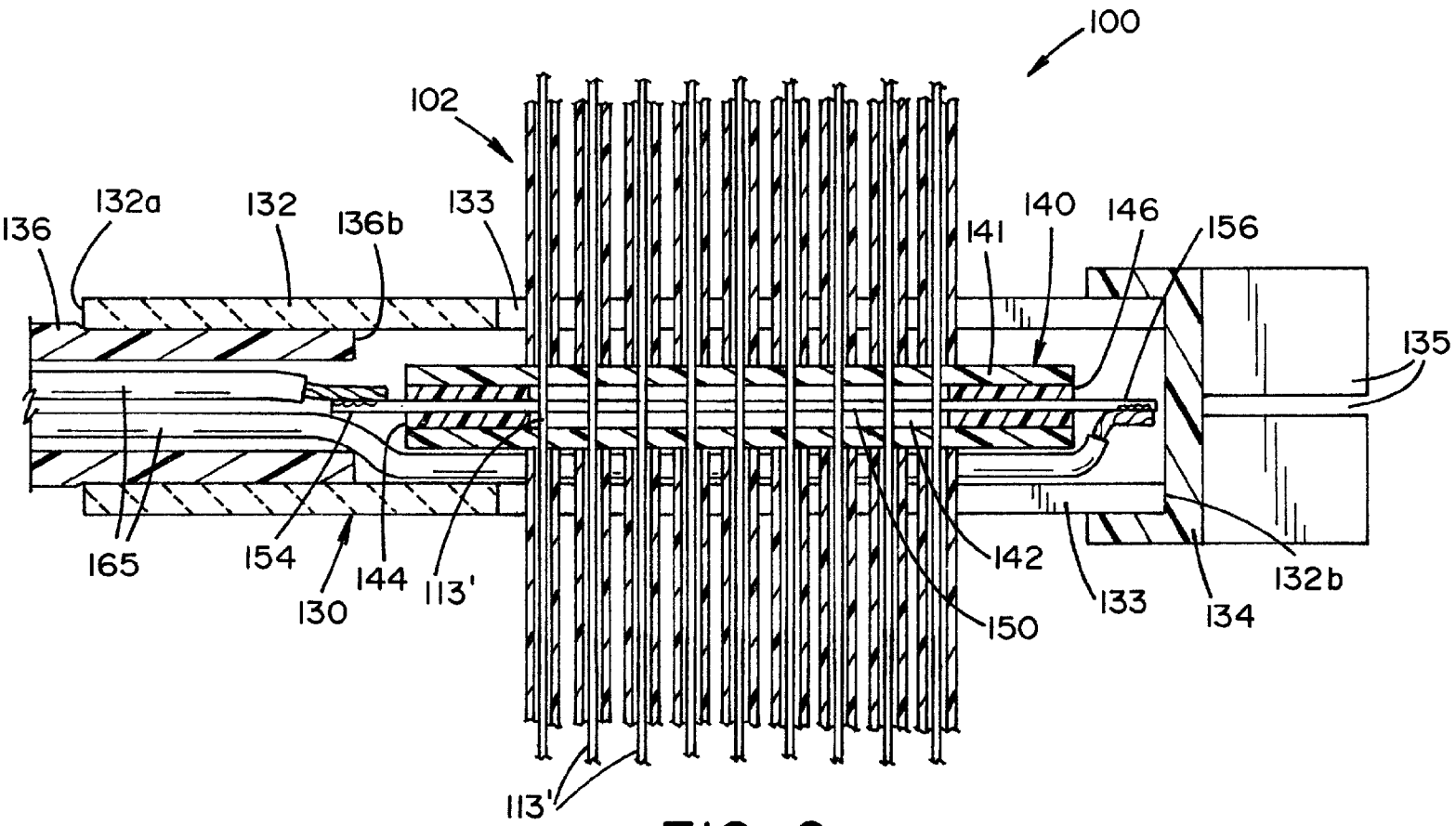
FIG. 6 is a cross-sectional view of a portion of the low-current fault interrupting section according to a second embodiment.

In accordance with an alternative embodiment of the present invention shown in FIG. 6, low-current fault interrupting section 100 has a fusible element 102 having only a single conducting member 113'. In this regard, second conducting members 123 are made of the same conductive material (described above) as first conducting members 113, and therefore fusible element 102 of low-current fault interrupting section 100 of the alternative embodiment has no exothermic reactive intermetallic material. However, trigger wire 150 remains made of an exothermic reactive intermettalic material. It is observed that the response time of fuse 10 according to the alternative embodiment is slower (as compared to the first embodiment described above) when a condition is detected in the control mode and when a low current fault occurs in the normal operating mode.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A medium voltage controllable fuse comprising:

a trigger wire comprised of an exothermic reactive intermetallic material, said trigger wire rapidly heating in response to a trigger signal and thereby initiating an exothermic reaction that destroys the trigger wire;

a high-current fault interrupting section responsible for opening the fuse and extinguishing arcs in the event of a high-current fault, said high-current fault interrupting section including a first fusible element comprised of a conducting member;

a low-current fault interrupting section responsible for opening the fuse and extinguishing arcs in the event of a low-current fault, said low-current fault interrupting section including:

a second fusible element series-connected with the first fusible element of the high-current fault interrupting section, wherein the second fusible element includes a first conducting member comprised of an exothermic reactive intermetallic material, and an isolating member providing an enclosure that defines an inner recess, wherein at least a section of the first conducting member of the second fusible element and at least a section of the trigger wire are located proximate to each other within the inner recess, said isolating member providing a void area around the section of the first conducting member and the section of the trigger wire; and a fuse housing defining a chamber for housing the trigger wire, the high-current fault interrupting section, and the low-current fault interrupting section, said fuse housing including a fuse body and a pair of conductive end caps mounted at opposite ends of the fuse body, wherein said high-current and low-current fault interrupting sections are connected in series between the pair of conductive end caps.

2. A medium voltage controllable fuse according to claim 1, wherein said second fusible element is further comprised of a second conducting member, said first conducting member and said second conducting member comprised of different conductive materials.

3. A medium voltage controllable fuse according to claim 1, wherein said second fusible element is further comprised of a second conducting member, said second conducting member comprised of an exothermic reactive intermetallic material.

4. A medium voltage controllable fuse according to claim 1, wherein the low-current fault interrupting section further comprises:

a housing that houses said isolating member inside the fuse housing.

5. A medium voltage controllable fuse according to claim 1, wherein said conducting member of the first fusible element is made of at least one of the following: silver, copper, copper alloy, aluminum, and zinc.

6. A medium voltage controllable fuse according to claim 5, wherein said conducting member of the first fusible element is a metal ribbon having perforations and/or notches.

7. A medium voltage controllable fuse according to claim 2, wherein said second conducting member of the second fusible element is made of at least one of the following: silver, copper, copper alloy, and aluminum.

8. A medium voltage controllable fuse according to claim 1, wherein said isolating member includes:

a casing; and a pair of end walls located at opposite ends of the casing.

9. A fuse system comprising:

(a) a medium voltage controllable fuse including:

a trigger wire comprised of an exothermic reactive intermetallic material, said trigger wire rapidly heating in response to a trigger signal and thereby initiating an exothermic reaction that destroys the trigger wire;

a high-current fault interrupting section responsible for opening the fuse and extinguishing arcs in the event of a high-current fault, said high-current fault interrupting section including a first fusible element comprised of a conducting member;

a low-current fault interrupting section responsible for opening the fuse and extinguishing arcs in the event of a low-current fault, said low-current fault interrupting section including:

a second fusible element series-connected with the first fusible element of the high-current fault interrupting section, wherein the second fusible element includes a first conducting member comprised of an exothermic reactive intermetallic material, and an isolating member providing an enclosure that defines an inner recess, wherein at least a section of the first conducting member of the second fusible element and at least a section of the trigger wire are located proximate to each other within the inner recess, said isolating member providing a void area around the section of the first conducting member and the section of the trigger wire; and a fuse housing defining a chamber for housing the trigger wire, the high-current fault interrupting section, and the low-current fault interrupting section, said fuse housing including a fuse body and a pair of conductive end caps mounted at opposite ends of the fuse body, wherein said high-current and low-current fault interrupting sections are connected in series between the pair of conductive end caps;

(b) a sensing device for detecting an external condition; and (c) a fuse controller electrically connected with said trigger wire, said fuse controller supplying the trigger signal in response to the sensing device detecting the external condition.

10. A fuse system according to claim 9, wherein said fuse controller includes an energy source for supplying a pulse of electrical energy to the trigger wire as said trigger signal.

11. A fuse system according to claim 10, wherein said fuse controller includes a switch for electrically connecting the energy source to said trigger wire.

12. A fuse system according to claim 9, wherein said external condition sensed by said sensing device is selected from one of the following:

an arc flash, an overvoltage condition, a temperature level, and a pressure level.

13. A fuse system according to claim 9, wherein said fuse controller is electrically connected to said trigger wire by connecting wires.

14. A medium voltage controllable fuse according to claim 1, wherein said trigger signal is a signal external to said medium voltage controllable fuse.

15. A medium voltage controllable fuse according to claim 1, wherein said trigger signal is supplied by a fuse controller.

16. A medium voltage controllable fuse according to claim 15, wherein said fuse controller supplies the trigger signal in response to a sensing device detecting an external condition.

17. A medium voltage controllable fuse according to claim 16, wherein said external condition detected by said sensing device is selected from one of the following:

an arc flash, an overvoltage condition, a temperature level, and a pressure level.

18. A medium voltage controllable fuse according to claim 1, wherein said medium voltage controllable fuse includes a plurality of said first fusible elements arranged in parallel.

19. A medium voltage controllable fuse according to claim 1, wherein said medium voltage controllable fuse includes a plurality of said second fusible elements arranged in parallel.

20. A medium voltage controllable fuse according to claim 1, wherein said section of the first conducting member and said section of the trigger wire located within the inner recess of the isolating member are oriented transverse to each other.

* * * * *